US011424580B2

(12) United States Patent
Kim et al.

(10) Patent No.: US 11,424,580 B2
(45) Date of Patent: Aug. 23, 2022

(54) COMPACT COAXIAL CABLE CONNECTOR FOR TRANSMITTING SUPER HIGH FREQUENCY SIGNALS

(71) Applicant: SENSORVIEW CO., LTD., Gyeonggi-do (KR)

(72) Inventors: Byoung Nam Kim, Gyeonggi-do (KR); Kyoung Il Kang, Gyeonggi-do (KR); Joung Min Park, Gyeonggi-do (KR); Sang Woo Han, Gyeonggi-do (KR)

(73) Assignee: SENSORVIEW CO., LTD., Gyeonggi-do (KR)

( * ) Notice: Subject to any disclaimer, the term of this patent is extended or adjusted under 35 U.S.C. 154(b) by 0 days.

(21) Appl. No.: 16/898,604

(22) Filed: Jun. 11, 2020

(65) Prior Publication Data

US 2020/0395717 A1 Dec. 17, 2020

(30) Foreign Application Priority Data

Jun. 14, 2019 (KR) ..... 10-2019-0071043
Nov. 13, 2019 (KR) ..... 10-2019-0145209

(51) Int. Cl.
*H01R 13/6593* (2011.01)
*H01R 12/75* (2011.01)
(Continued)

(52) U.S. Cl.
CPC ..... *H01R 13/6593* (2013.01); *H01R 12/75* (2013.01); *H01R 9/0515* (2013.01);
(Continued)

(58) Field of Classification Search
CPC ..... H01R 13/6593; H01R 12/75; H01R 13/6594; H01R 13/6582; H01R 12/777;
(Continued)

(56) References Cited

U.S. PATENT DOCUMENTS

2005/0095902 A1 5/2005 Zhang et al.
2006/0228952 A1* 10/2006 Feldman ..... H01R 4/024 439/835
(Continued)

FOREIGN PATENT DOCUMENTS

WO WO-2008/123652 A1 10/2008

OTHER PUBLICATIONS

Extended European Search Report from corresponding European Patent Application No. 20179712.3, dated Nov. 10, 2020.

*Primary Examiner* — Abdullah A Riyami
*Assistant Examiner* — Justin M Kratt
(74) *Attorney, Agent, or Firm* — Harness, Dickey & Pierce, P.L.C.

(57) ABSTRACT

Disclosed is a compact coaxial cable connector for transmitting super-high frequency signals, which is adapted to connect a PCB to a single or multiple super-high frequency coaxial cable signal lines transmitting super-high frequency signals therethrough. The compact coaxial cable connector includes: a single or multiple coaxial cables each including an inner conductor, an outer conductor, a dielectric, and a sheath, wherein the outer conductor, the dielectric, and the sheath are stripped to expose the inner conductor over a predetermined length and a terminal of the exposed inner conductor is brought into electrical contact with a circuit signal line terminal pad formed on the PCB; and a male connector including a shielding can receiving the exposed inner conductors of the single or multiple coaxial cables, securing and protecting ends of the exposed inner conductors, and blocking electromagnetic waves generated from the inner conductors of the single or multiple coaxial cables.

9 Claims, 12 Drawing Sheets

(51) Int. Cl.

| | |
|---|---|
| *H01R 13/6582* | (2011.01) |
| *H01R 12/77* | (2011.01) |
| *H01R 13/02* | (2006.01) |
| *H01R 13/502* | (2006.01) |
| *H01R 9/05* | (2006.01) |
| *H01R 12/79* | (2011.01) |
| *H01R 12/71* | (2011.01) |
| *H01R 13/6591* | (2011.01) |
| *H01R 12/59* | (2011.01) |
| *H01R 13/6581* | (2011.01) |
| *H01R 24/50* | (2011.01) |
| *H01R 13/6594* | (2011.01) |
| *H01R 24/00* | (2011.01) |

(52) U.S. Cl.

CPC ..... *H01R 12/598* (2013.01); *H01R 12/714* (2013.01); *H01R 12/716* (2013.01); *H01R 12/775* (2013.01); *H01R 12/777* (2013.01); *H01R 12/778* (2013.01); *H01R 12/79* (2013.01); *H01R 13/02* (2013.01); *H01R 13/502* (2013.01); *H01R 13/6581* (2013.01); *H01R 13/6582* (2013.01); *H01R 13/6591* (2013.01); *H01R 13/6594* (2013.01); *H01R 24/00* (2013.01); *H01R 24/50* (2013.01)

(58) Field of Classification Search

CPC ..... H01R 13/6591; H01R 12/778; H01R 12/775; H01R 12/716; H01R 12/79; H01R 12/598; H01R 12/714; H01R 9/0515; H01R 24/50; H01R 13/6581; H01R 13/02; H01R 24/00; H01R 13/502

See application file for complete search history.

(56) References Cited

U.S. PATENT DOCUMENTS

| | | | | |
|---|---|---|---|---|
| 2010/0203771 | A1* | 8/2010 | Bailleul ..... | H01R 12/52 439/701 |
| 2014/0187087 | A1* | 7/2014 | Mason ..... | H01R 13/6592 439/607.36 |

* cited by examiner

COMPACT COAXIAL CABLE CONNECTOR FOR TRANSMITTING SUPER HIGH FREQUENCY SIGNALS

CROSS-REFERENCE TO RELATED APPLICATION

This application claims the benefit of Korean Patent Application No. 10-2019-0071043 filed on Jun. 14, 2019 and Korean Patent Application No. 10-2019-0145209 filed on Nov. 13, 2019, the entire disclosures of which are incorporated herein by references.

FIELD

The present invention relates to a connector for transmitting super-high frequency signals, and, more particularly, to a compact coaxial cable connector for transmitting super-high frequency signals, which is a multi-connector having a structure allowing signal lines in a male connector thereof to be directly connected to signal line pads on a printed circuit board.

BACKGROUND

FIG. 1 is a sectional view of a typical printed circuit board (PCB) mono- or multi-connector. In the PCB mono- or multi-connector, a male connector 112 including a male connector housing 112 covering a terminal of an electrical signal line 114 for transmitting electrical signals, such as a cable or a wire, is inserted into and connected to a female connector (or socket) 150 mounted on a PCB 160. Here, a female connector housing 152 of the female connector 150 is provided with a reception member 154 receiving the terminal (or pin) in the male connector. However, such a typical PCB mono- or multi-connector has a problem in that leakage current and noise are likely to occur through the reception member 154, causing signal loss, and there is a limit to miniaturization of the connector.

SUMMARY

Embodiments of the present invention have been conceived to solve such a problem of typical mono- or multi-connectors and it is an aspect of the present invention to provide a compact coaxial cable connector for transmitting super-high frequency signals, which includes a female connector that includes only a housing socket mounted on a PCB and receiving a male connector housing without a separate terminal reception member for receiving signal line terminals in a male connector, such that the terminals in the male connector can be brought into direct contact with terminal pads on the PCB, respectively, thereby minimizing signal loss and allowing miniaturization through significant reduction in height of the connector while allowing connection of a single or multiple coaxial cables thereto.

In accordance with an aspect of the present invention, there is provided a compact coaxial cable connector for transmitting super-high frequency signals, which is adapted to connect a printed circuit board (PCB) to a single or multiple super-high frequency coaxial cable signal lines transmitting super-high frequency signals therethrough, the compact coaxial cable connector including: a single or multiple coaxial cables each including an inner conductor, an outer conductor, a dielectric, and a sheath, wherein the outer conductor, the dielectric, and the sheath are stripped to expose the inner conductor over a predetermined length and a terminal of the exposed inner conductor is brought into electrical contact with a circuit signal line terminal pad formed on the PCB; a male connector including a shielding can receiving the exposed inner conductors of the single or multiple coaxial cables, securing and protecting ends of the exposed inner conductors, and blocking electromagnetic waves generated from the inner conductors of the single or multiple coaxial cables; and a connector socket mounted on the PCB, receiving the shielding can to be fastened to the male connector, and electrically connected to the shielding can and a ground terminal of the PCB, wherein, upon fastening the male connector to the connector socket, the super-high frequency coaxial cable signal line terminals in the male connector are brought into direct contact with and connected to the circuit signal line terminal pads formed on the PCB, respectively.

The male connector may further include adapters each connected at one end thereof to corresponding one of the single or multiple super-high frequency coaxial cable signal lines and connected at the other end thereof to corresponding one of the circuit signal line terminal pads formed on the PCB to allow contact between the coaxial cable signal lines and the respective signal line terminal pads on the PCB, and the super-high frequency coaxial cable signal lines are connected to the circuit signal line terminal pads formed on the PCB via the adapters of the male connector, respectively.

The shielding can may include an adapter reception portion receiving the adapters one-to-one connected to the inner conductors of the multiple coaxial cables, the adapter reception portion being configured to individually shield the adapters; and the exposed inner conductors of the multiple coaxial cables and the adapters may be electrically shielded. The connector socket may further include a fastening portion to be fastened to the male connector. The connector socket may be mounted on the PCB by surface-mount technology (SMT) or through-hole mount technology, such as single in-line package (SIP) technology, dual in-line package (DIP) technology, and quad in-line package (QIP) technology.

The connector socket may be mounted on the PCB by combination of surface-mount technology (SMT) and through-hole mount technology, such as single in-line package (SIP) technology, dual in-line package (DIP) technology, and quad in-line package (QIP) technology. The connector socket may have a cuboid shape, may be open at the bottom thereof and at one side thereof into which the male connector is inserted, and may be partially open at the top thereof, the male connector may be inserted into the connector socket in a direction parallel to a bottom surface of the PCB or at an angle to the bottom surface of the PCB. The connector socket may have a cuboid shape, may be open at the bottom thereof and at one side thereof into which the male connector is inserted, and may have an upper surface provided in the form of a reclosable lid opened at a right angle, an acute angle, or an obtuse angle; and, upon inserting the male connector into the connector socket, the male connector can be inserted in a direction parallel to an upper surface of the PCB, can be obliquely inserted at an acute angle or an obtuse angle to the upper surface of the PCB, can be inserted while descending at a right angle, or can be inserted in a direction in which the lid is closed.

In the coaxial cable connector for transmitting super high-frequency signals according to the present invention, a reception member that is typically provided to a connector socket to receive coaxial cable signal line terminals in a male connector is omitted such that the signal line terminals in the male connector can be bought into direct contact with circuit signal line terminal pads on a PCB, respectively, or adapters are provided to allow easy contact between the coaxial cable signal line terminals in the male connector and the respective circuit signal line terminal pads on the PCB, thereby minimizing leakage current and noise and thus reducing signal loss while allowing minimization of the connector through reduction in fastening height and width of the coaxial cable mono- or multi-connector.

In addition, according to the present invention, outer conductors, which are shielding layers of coaxial cables connected to the male connector, are connected to a shielding can blocking electromagnetic waves generated from inner conductors, which are signal lines of the coaxial cables, and the connector socket mounted on the PCB and connected to a ground terminal of the PCB is brought into contact with and electrically connected to the shielding can of the male connector by receiving the shielding can to provide electrical shielding, thereby reducing signal loss in the signal line terminals in the male connector, which directly contact the circuit signal terminal pads of the PCB, respectively.

Further, according to the present invention, since it is possible to eliminate the need to provide a separate reception member receiving the signal line terminals in the male connector to the connector socket, the structure of the connector socket can be simplified, thereby allowing reduction in manufacturing cost.

DETAILED DESCRIPTION

Hereinafter, embodiments of the present invention will be described with reference to the accompanying drawings. It will be understood that the embodiments and the drawings described in the specification are not exhaustive but solely illustrative and there are present various alterations and equivalent embodiments thereof at the time of filing the present application.

A coaxial cable connector for transmitting super-high frequency signals according to the present invention is a PCB connector that connects a printed circuit board (PCB) to a single or multiple coaxial cable signal lines transmitting super-high frequency signals therethrough, and includes a male connector and a connector socket. The male connector includes a single or multiple coaxial cables and a shielding can.

The single or multiple coaxial cables include an inner conductor, an outer conductor, a dielectric, and a sheath, wherein the sheath, the outer conductor, and the dielectric are stripped to expose the inner conductor over a predetermined length, and a terminal of the exposed inner conductor is brought into electrical contact with a circuit signal line terminal pad formed on the PCB. The shielding can receives the exposed inner conductors of the single or multiple coaxial cables, secures and protects ends of the exposed inner conductors, and blocks electromagnetic waves generated from the inner conductors.

The connector socket is mounted on the PCB, receives the shielding can to be fastened to the male connector, and is electrically connected to the shielding can and a ground terminal of the PCB. When the connector socket is fastened to the male connector, super-high frequency coaxial cable signal line terminals in the male connector are brought into direct contact with and connected to the circuit signal line terminal pads formed on the PCB, respectively.

The male connector may further include adapters. The adapters allow the single or multiple coaxial cable signal lines to contact the respective signal line terminal pads on the PCB, and are each connected at one end thereof to corresponding one of the super-high frequency coaxial cable signal lines and connected at the other end thereof to corresponding one of the circuit signal line terminal pads formed on the PCB. That is, the super-high frequency signal lines are brought into contact with and connected to the circuit signal line terminal pads formed on the printed circuit board via the adapters of the male connector, respectively. The shielding can may include an adapter reception portion. The adapter reception portion receives the adapters one-to-one connected to the inner conductors of the coaxial cables, and is configured to individually shield the adapters. That is, the shape of the adapter reception portion allows the exposed inner conductors of the coaxial cables and the adapters received in the shielding can to be individually electrically shielded.

Figure 1:
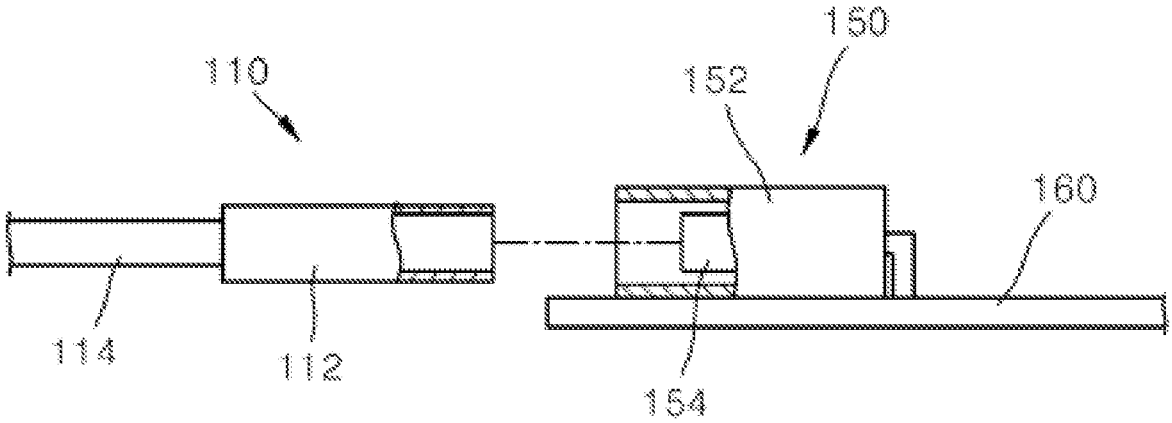
Prior Art FIG. 1
FIG. 1 is a sectional view of a typical PCB mono- or multi-connector.
Figure 2:
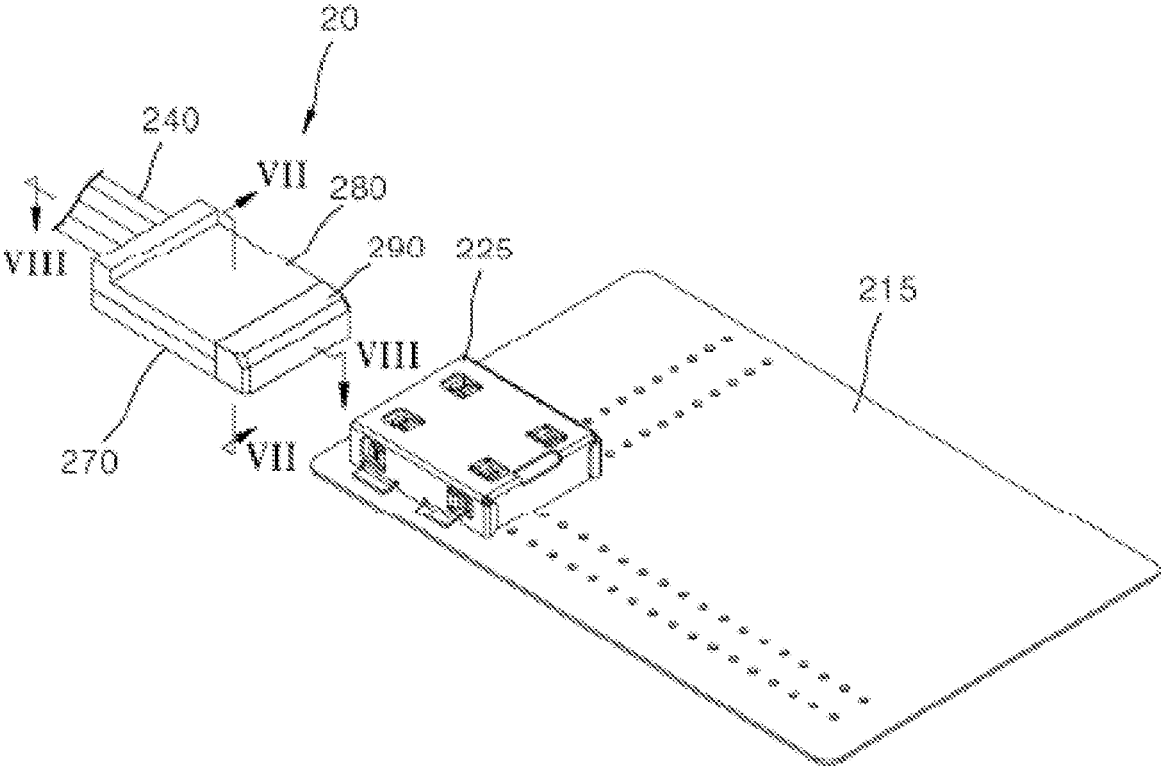
FIG. 2 is a view of an example of a coaxial cable connector for transmitting super-high frequency signals according to the present invention, with a male connector not fastened to a connector socket mounted on a PCB.
Figure 3:
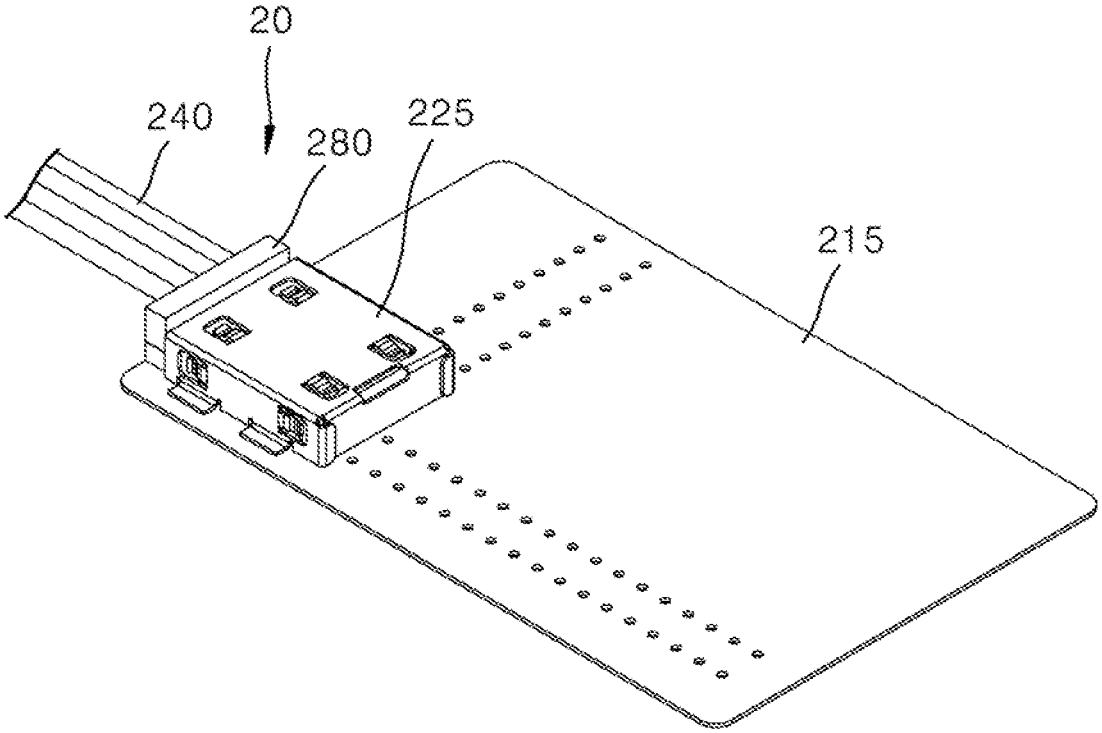
FIG. 3 is a view of the coaxial cable connector for transmitting super-high frequency signals according to the present invention, with the male connector fastened to the connector socket mounted on the PCB.

FIG. 2 is a view of an example of the coaxial cable connector for transmitting super-high frequency signals according to the present invention, with a male connector 20 not fastened to a connector socket 225 mounted on a PCB 215. FIG. 3 is a view of the coaxial cable connector for transmitting super-high frequency signals according to the present invention, with the male connector 20 fastened to the connector socket 225 mounted on the PCB 215. Referring to FIG. 2 and FIG. 3, a shielding can 270, 280, 290 of the male connector connected to coaxial cables 240 is inserted into and fastened to the connector socket 225 mounted on the PCB 215. Here, connection between the PCB and the coaxial cables 240 is established by bringing cable terminals formed on a bottom surface of the male connector 20 into direct contact with circuit signal line terminal pads formed on the PCB 215, respectively.

Figure 4:
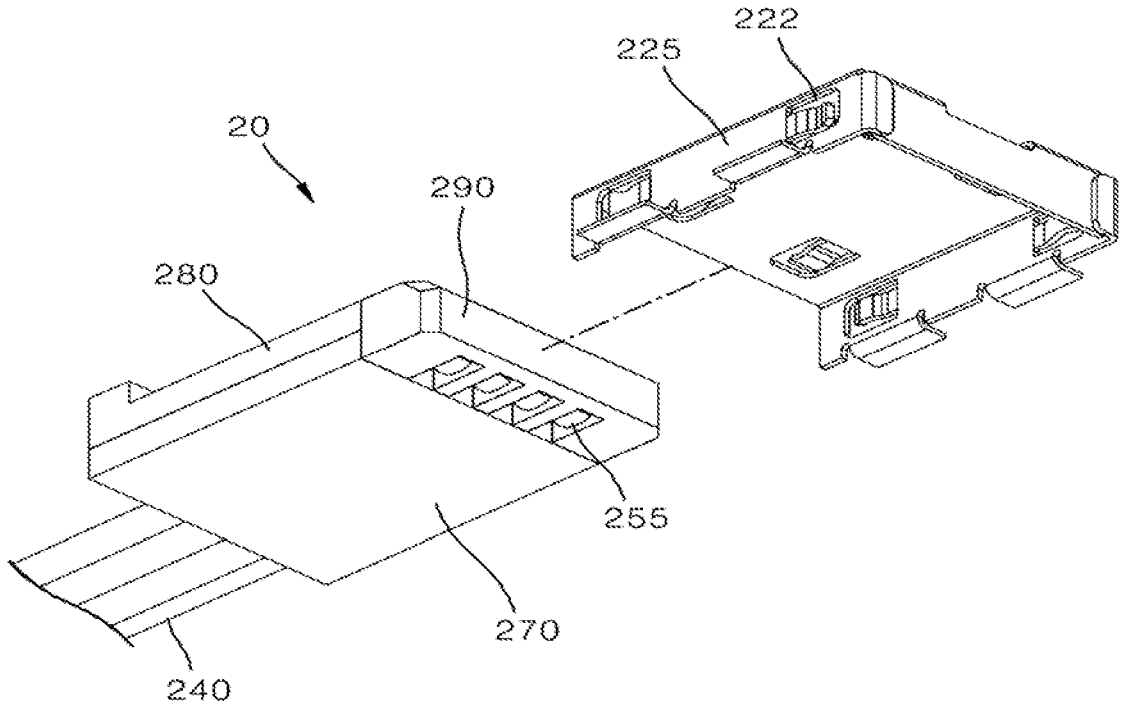
FIG. 4 is a bottom perspective view of the male connector and the connector socket of the coaxial cable connector for transmitting super-high frequency signals according to the present invention.
Figure 5:
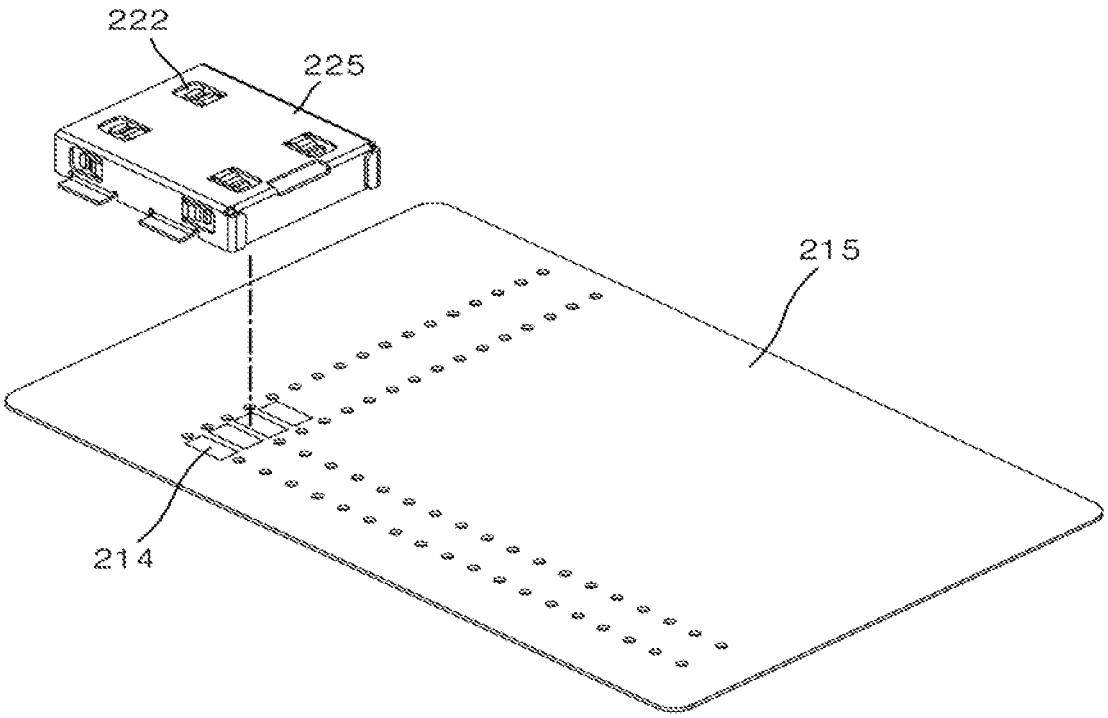
FIG. 5 is an exploded perspective view of an example of the connector socket of the coaxial cable connector for transmitting super-high frequency signals according to the present invention.

FIG. 4 is a bottom perspective view of the male connector 20 and the connector socket 225 of the coaxial cable connector for transmitting super-high frequency signals according to the present invention. FIG. 5 is an exploded perspective view of the coaxial cable connector for transmitting super-high frequency signals according to the present invention, showing an example of the connector socket 225 and the PCB 215. Referring to FIG. 4 and FIG. 5, signal line terminals 255 of the cables are formed on the bottom surface of the male connector 20. The connector socket 225 may include a fastening portion 222 to be fastened to the male connector 20.

When the male connector 20 is fastened to the connector socket 225, the signal line terminals 255 of the cables formed on the bottom surface of the male connector 20 are brought into direct contact with and connected to the circuit signal terminal pads 214 formed on the PCB 215, respectively, without using a separate reception member receiving the signal line terminals 255. Here, the connector socket 225 mounted on the PCB 215 is fastened to the male connector 20 by receiving the shielding can 270, 280, 290 of the male connector 20, and the shielding can 270, 280, 290, the connector socket 225, and the ground of the PCB 215 are electrically connected to one another to shield the exposed inner conductors of the coaxial cables and the adapters, thereby minimizing leakage current and noise and thus reducing signal loss. In addition, according to the present invention, since the connector socket 225 mounted on the PCB 215 is not provided with such a reception member receiving the cable signal line terminals 260, as shown in FIG. 4, the structure of the connector socket can be simplified and the height at which the connector socket is fastened to the male connector 20 and the width over which the connector socket is fastened to the male connector 20 can be minimized, thereby allowing miniaturization of the connector socket. The coaxial cable connector for transmitting super-high frequency signals according to the present invention may be applied to various electronic devices requiring miniaturization of a related connector, such as tablet PCs, laptop PCs, 5G smartphones, and home appliances (for example, TVs, refrigerators, washing machines, and the like).

Figure 6A:
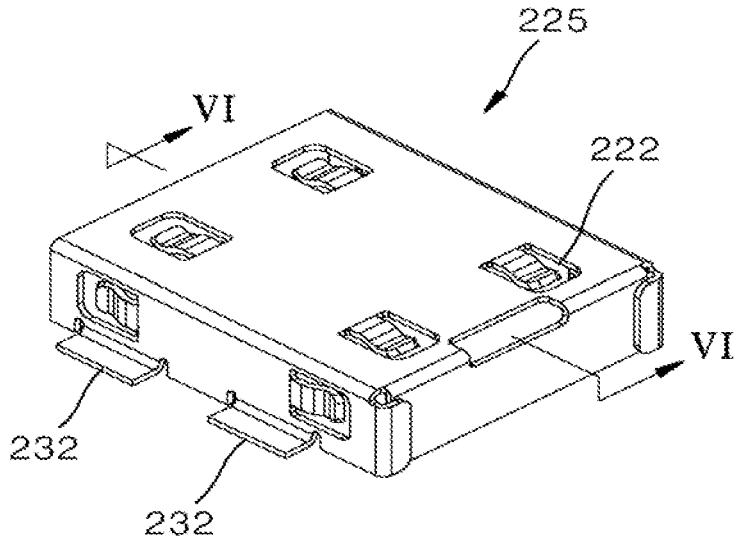
FIG. 6A, FIG. 6B, and FIG. 6C show various methods of mounting the connector socket 225 on the printed circuit board (PCB) 215.
Figure 6B:
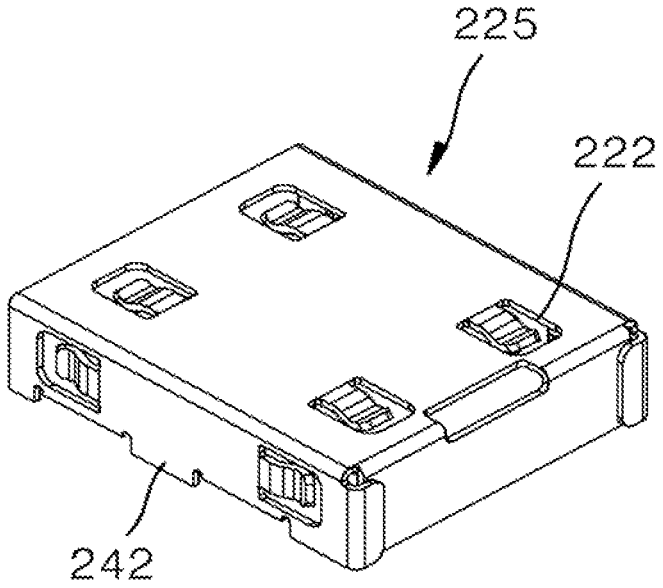
Figure 6C:
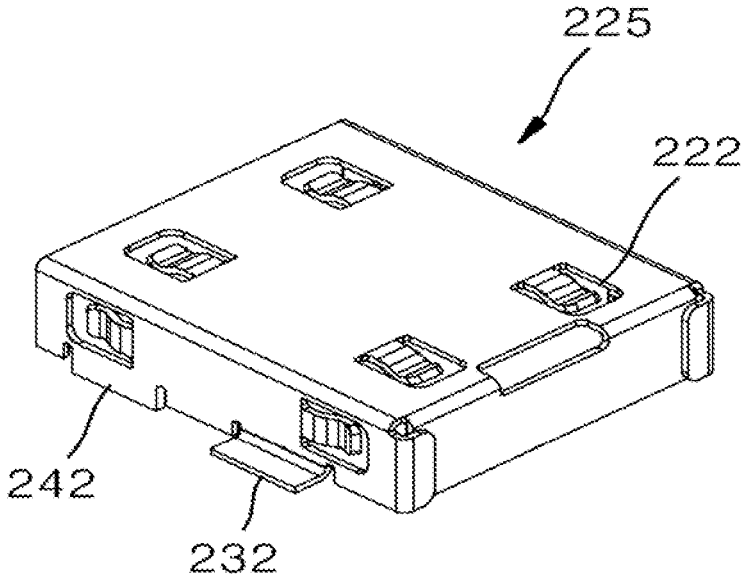

FIG. 6A, FIG. 6B, and FIG. 6C show various methods of mounting the connector socket 225 on the PCB 215. The connector socket 225 may be mounted on a surface of the PCB 215 or may be mounted on a through-hole of the PCB 215. FIG. 6A is a view of a connector socket 225 mounted on the PCB 215 by surface-mount technology (SMT), wherein the connector socket is mounted on the surface of the PCB via a surface-mounted member 232.

FIG. 6B is a view of a connector socket 225 mounted on the PCB 215 by through-hole-mount technology, wherein the connector socket is mounted on a through-hole of the PCB via a through-hole-mounted member 242. Examples of through-hole-mount technology may include single in-line package (SIP) technology, dual-in-line package (DIP) technology, and quad in-line package (QIP) technology. FIG. 6C is a view of a connector socket 225 mounted to the PCB 215 by both SMT and through-hole-mount technology, wherein the connector socket is mounted on the PCB 215 via both the surface-mounted member 232 and the through-hole-mounted member 242.

Alternatively, the connector socket 225 may be integrally formed with the PCB, rather than formed separately from the PCB.

Figure 7:
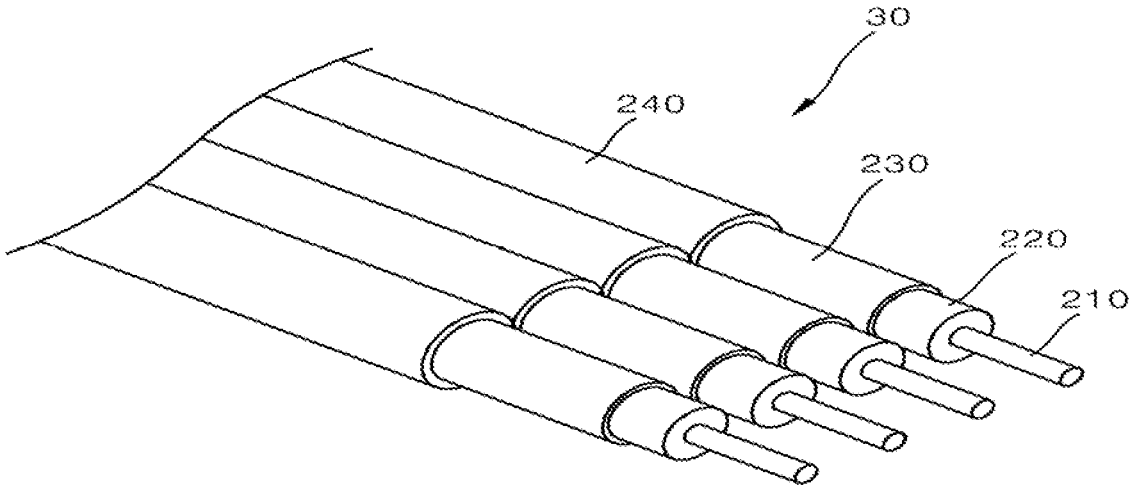
FIG. 7 is a view of exemplary components constituting the male connector of the coaxial cable connector for transmitting super-high frequency signals according to the present invention.

FIG. 7 is a view of coaxial cables 30 connected to the male connector 20 of the coaxial cable connector for transmitting super-high frequency signals according to the present invention. Referring to FIG. 7, each of the coaxial cables 30 includes an inner conductor 210 used as a signal line, an outer conductor 230 formed of aluminum, copper, or the like and blocking electromagnetic waves generated from the inner conductor 210, a dielectric 220 insulating and isolating the inner conductor 210 from the outer conductor 230, and a sheath (or jacket) protecting the outer conductor 230. The internal conductor may transmit various electrical signals, such as DC signals, microwave signals, and millimeter wave signals, particularly, super-high frequency signals of about 50 GHz or more.

Figure 8:
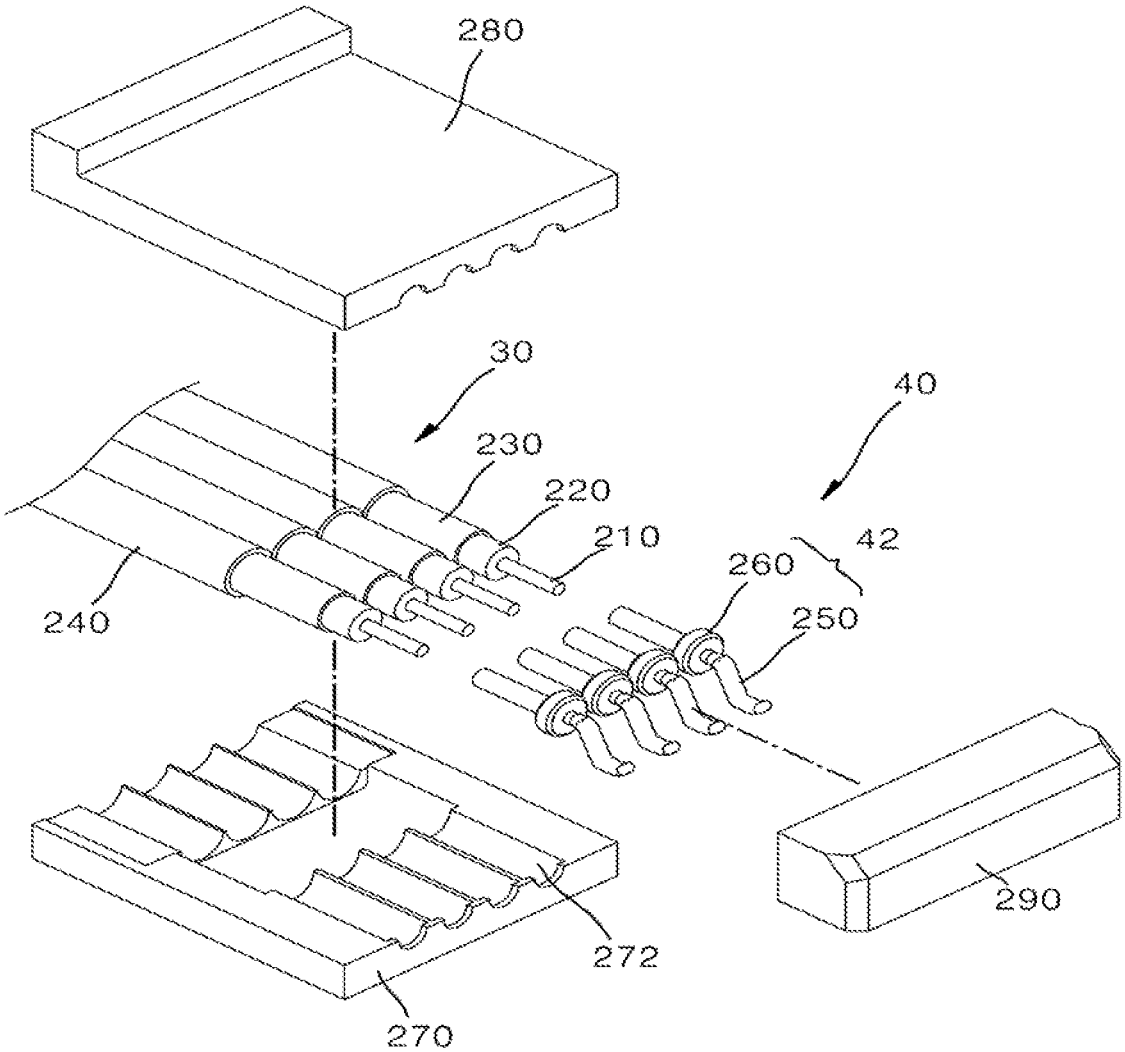
FIG. 8 is a view of exemplary coaxial cables connected to the male connector of the coaxial cable connector for transmitting super-high frequency signals according to the present invention.

FIG. 8 is a view of exemplary components constituting the male connector 20 of the coaxial cable connector for transmitting super-high frequency signals according to the present invention. The male connector 20 of the coaxial cable connector for transmitting super-high frequency signals according to the present invention includes the coaxial cables 30 and the shielding can 270, 280, 290 and may further include an adapter unit 40. The sheath 240, the outer conductor 230, and the dielectric 220 of the coaxial cable 30 are partially stripped. The outer conductors 130 of the coaxial cables 30 may be connected to the shielding can 270, 280, 290. The shielding can 270, 280, 290 receives, protects, and secures the coaxial cables 30 and blocks electromagnetic waves generated from the inner conductors 210 of the coaxial cables when coupled to the PCB. The shielding can 270, 280, 290 may be formed by coupling a lower shielding member 270, an upper shielding member 280, and a front shielding member 290 to one another. However, it will be understood that the present invention is not limited thereto and the shielding can may be composed of one shielding member in which at least two of the lower shielding member 270, the upper shielding member 280, and the front shielding member 290 are integrally formed with one another.

The adapter unit 40 includes multiple adapters. Each of the adapters 42 is configured to be easily shielded by the shielding can 270, 280, 290 and to allow easy connection between the inner conductor 210 of the coaxial cable 30 and the circuit signal line terminal pad 214 formed on the PCB 215, and includes a conductor portion 250 and a dielectric portion 260. One end of the conductor portion 250 is brought into contact with and connected to the signal line terminal pad 214 of the PCB 215 and the other end of the conductor portion 250 receives and is connected to the signal line 210, that is, the inner conductor of the coaxial cable 30. When the inner conductor, that is, the signal line of the cable, is inserted into and connected to the adapter 42, the one end of the conductor portion 250, which corresponds to the cable signal line terminal 255 of FIG. 4, is brought into contact with and connected to the signal line terminal pad 214 of the PCB 215. The dielectric portion 260 serves to separate the conductor portion 250 received in the shielding can 270, 280, 290 from the shielding can.

The shielding can 270, 280, 290, 310, 320, 410 includes an adapter reception portion 272 formed therein and having cylindrical portions adapted to receive the adapters 42 one-to-one connected to the inner conductors 210 of the single or multiple coaxial cables, respectively. The adapter reception portion 272 is configured to form shielding walls adapted to separate the adapters received in the adapter reception portion from one another and to shield the adapters upon coupling of the lower shielding member 270 to the upper shielding member 280 and the front shielding member 290.

Figure 9:
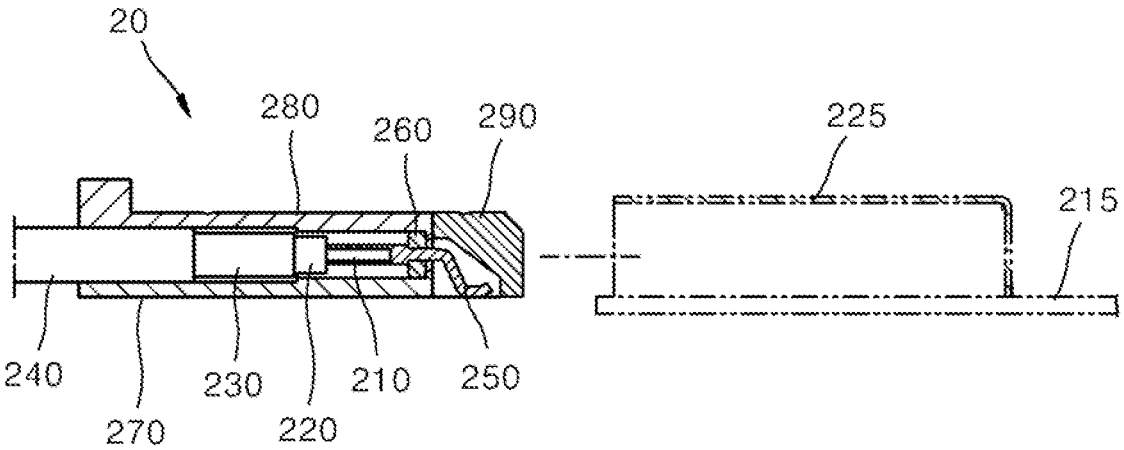
FIG. 9 is a sectional view of the male connector 20 of FIG. 2, taken along line VII-VII.
Figure 10:
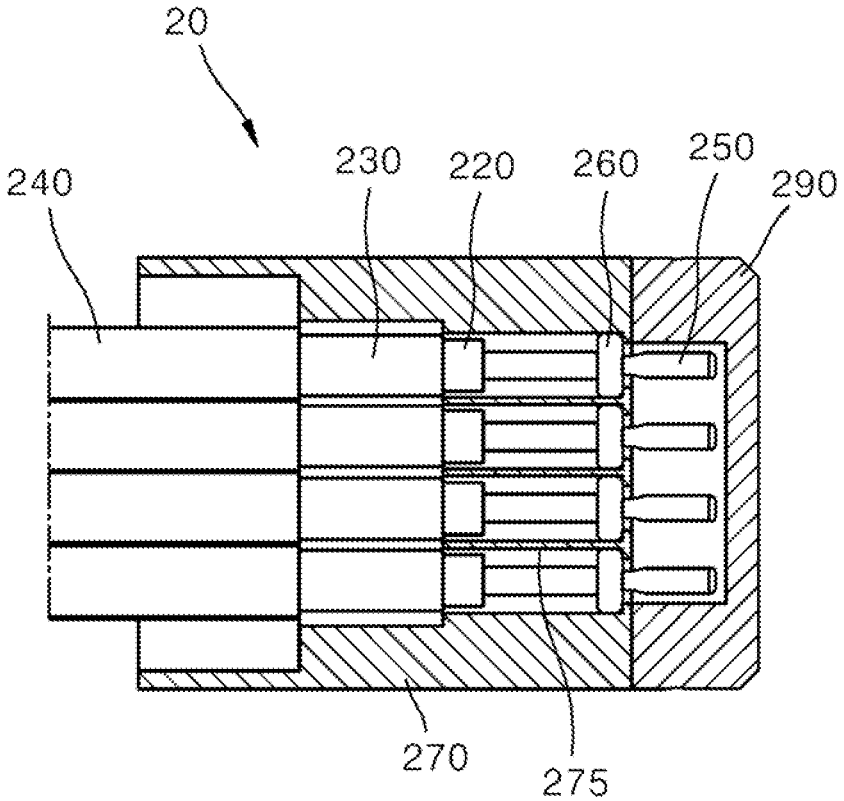
FIG. 10 is a sectional view of the male connector of FIG. 2, taken along line VIII-VIII.
Figure 11:
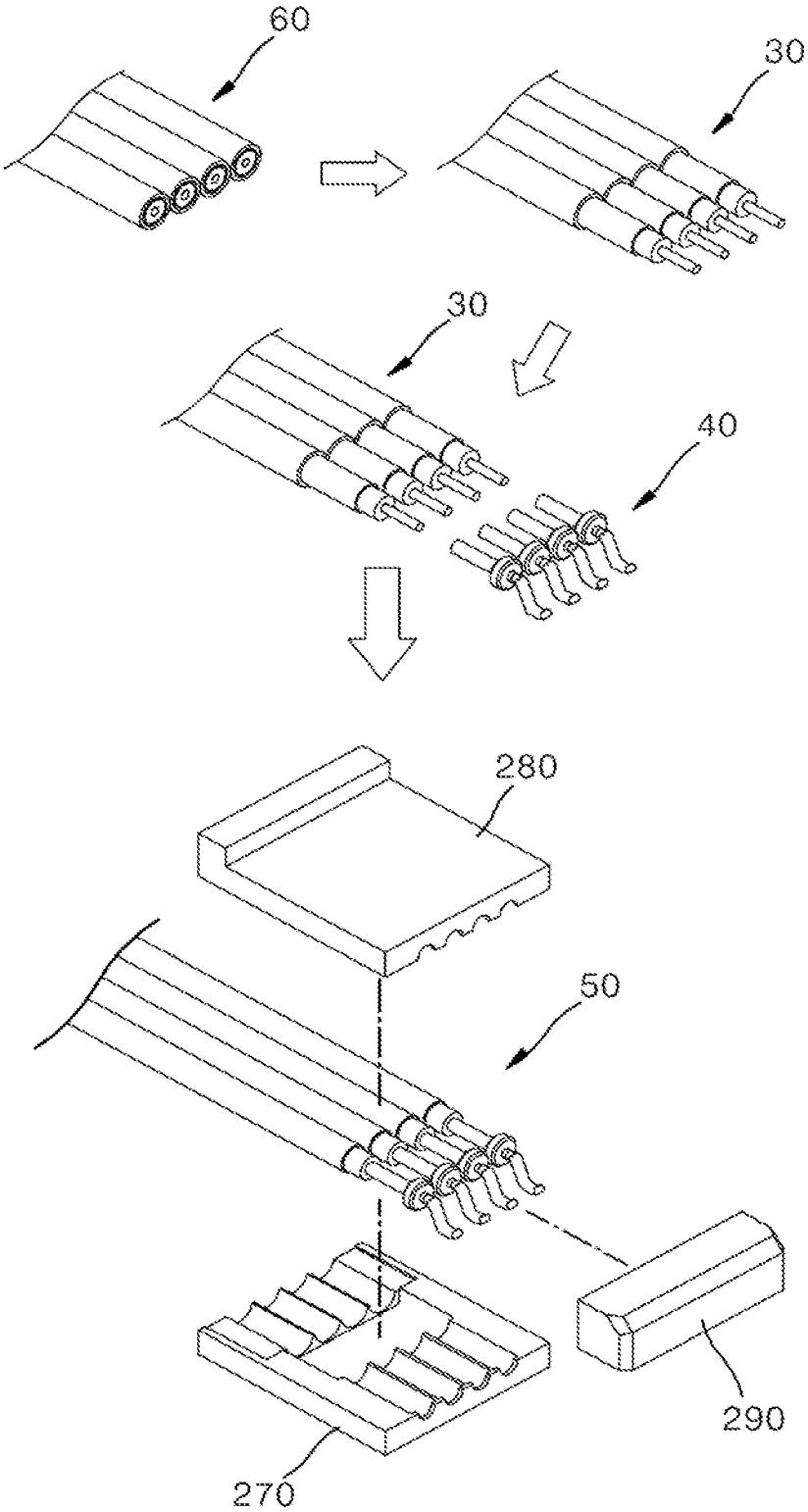
FIG. 11 is a view showing a process of assembling the male connector of the coaxial cable connector for transmitting super-high frequency signals according to the present invention.

FIG. 9 is a sectional view of the male connector 20 according to the present invention shown in FIG. 2, taken along line VII-VII, and FIG. 10 is a sectional view of the male connector of FIG. 2, taken along line VIII-VIII. Referring to FIG. 9 and FIG. 10, with the coaxial cables 210, 220, 230, 240 and the adapters 250, 260 received, protected, and shielded by the shielding can 270, 280, 290, the male connector 20 is inserted into and fastened to the connector socket 225 mounted on the PCB 215. In particular, FIG. 10 shows the shielding walls 275 formed by coupling the lower shielding member 270, the upper shielding member 280, and the front shielding member 290 to one another, wherein the shielding walls separate the adapters from one another while shielding the adapters. FIG. 11 is a view showing a process of assembling the male connector of the coaxial cable connector for transmitting super-high frequency signals according to the present invention. Referring to FIG. 11, unstripped coaxial cables 60 are stripped, followed by connecting the stripped coaxial cables 30 to the adapter unit 40, and then the coaxial cables 50 connected to the adapter unit 40 are seated on the lower shielding member 270, which, in turn, is coupled to the upper shielding member 280 and the front shielding member 290.

The PCB multi-connector according to the present invention can provide maximized shielding against electromagnetic waves generated from signal lines when coaxial cables are used as the signal lines. Specifically, the shielding can 270, 280, 290 of the male connector 20 is connected to the outer conductors 230 of the coaxial cables 30. The connector socket 225 formed of a conductor is connected to a ground terminal of the PCB 215. In this way, the lower shielding member 270 can be electrically connected to the ground terminal of the PCB 215, thereby providing shielding against electromagnetic waves.

When the male connector 20 is inserted into and fastened to the connector socket 225 mounted on the PCB 215, the shielding can 270, 280, 290 of the male connector 20 connected to the outer conductors 230 of the coaxial cables 30 is brought into contact with and connected to the connector socket 225 connected to the ground terminal of the PCB 215, thereby providing maximized shielding against electromagnetic waves generated from the signal line terminals of the male connector, which directly contact the terminal pads 214 on the PCB 215, respectively.

The connector socket 225 may have a cuboid shape. However, it will be understood that the present invention is not limited thereto and the connector socket 225 may have various shapes, such as a cube shape, a semi-cylindrical shape, and a polyhedral shape, in addition to a cuboid shape.

Figure 12A:
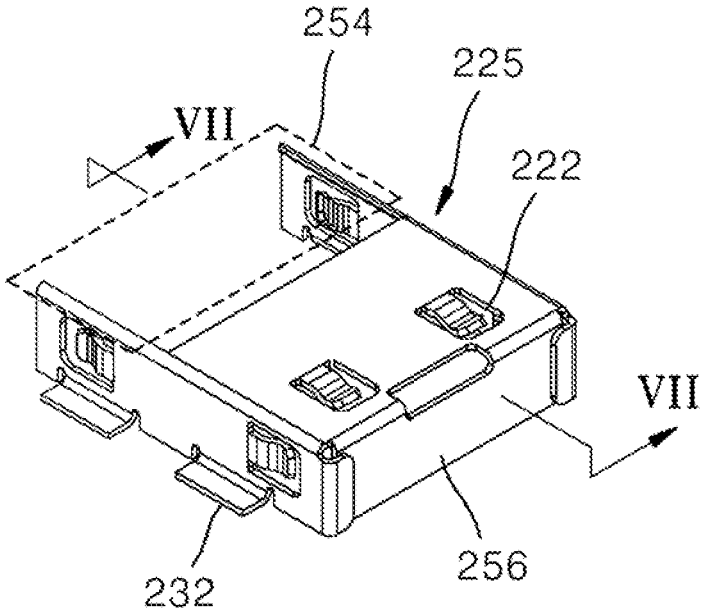
FIG. 12A is a view of one embodiment of a lid of a connector socket 225 having a cuboid shape, wherein the connector socket 225 is partially open at the top thereof to form an upper opening 254.
Figure 12B:
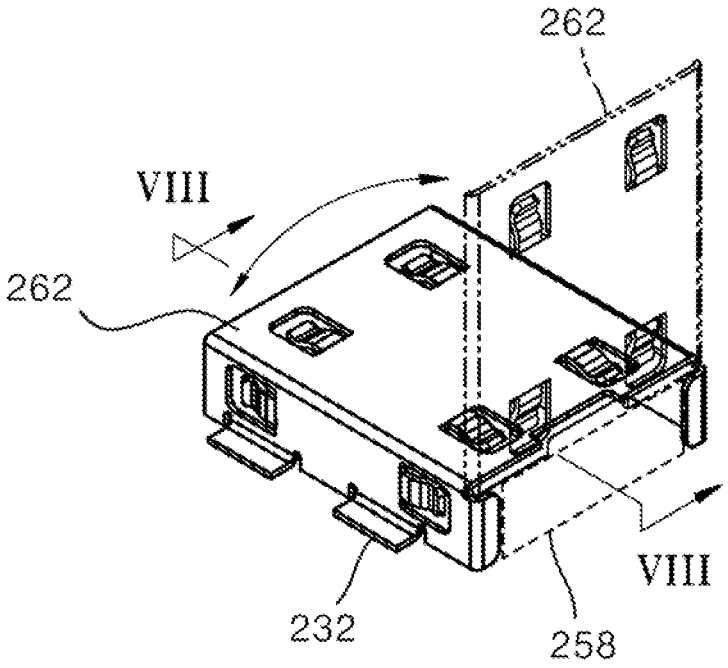
FIG. 12B is a view of another embodiment of the lid of the connector socket 225 having a cuboid shape, wherein the connector socket 225 has an upper surface provided in the form of a reclosable lid that is opened at a right angle.

FIG. 12A and FIG. 12B show various embodiments of a lid of a connector socket 225 having a cuboid shape. FIG. 12A is a view of a connector socket 225 which is partially open at the top thereof to form an upper opening 254. Here, assuming that the male connector 20 is inserted into the left side of the connector socket 225, the connector socket may be open at the bottom thereof at which the connector socket is fastened to the PCB and at the left side thereof into which the connector is inserted, and may be partially open at the right side thereof (not shown). Although the connector socket is shown as including the surface-mounted member 232 in FIG. 12A, it will be understood that the present invention is not limited thereto and the connector socket may include the through-hole-mounted member (not shown) or may include both the surface-mounted member and the through-hole-mounted member.

FIG. 12B is a view of a connector socket 225 having an upper surface provided in the form of a reclosable lid that can be opened at a right angle, an acute angle, or an obtuse angle. Referring to FIG. 12B, assuming that the male connector 20 is inserted into the left side of the connector socket 225, the connector socket may have an upper surface 262 provided in the form of a reclosable lid 262 opened at a right angle, an acute angle, or an obtuse angle, may be open at the bottom thereof at which the connector socket is fastened to the PCB and at the left side thereof into which the connector is inserted, and may be partially open at the right side thereof to form a right opening 258. Although the connector socket is shown as including the surface-mounted member 232 in FIG. 12A, it will be understood that the present invention is not limited thereto and the connector socket may include the through-hole-mounted member (not shown) or may include both the surface-mounted member and the through-hole-mounted member.

Figure 13:
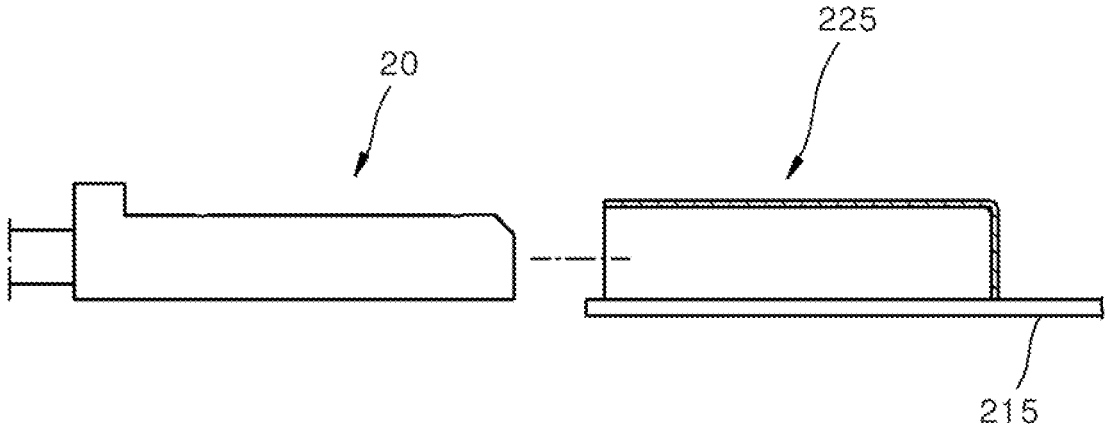
FIG. 13 is a sectional view taken along line VI-VI of FIG. 6A, showing insertion of the male connector 20 into the connector socket 225 of FIG. 6A mounted on the PCB 215.
Figure 14:
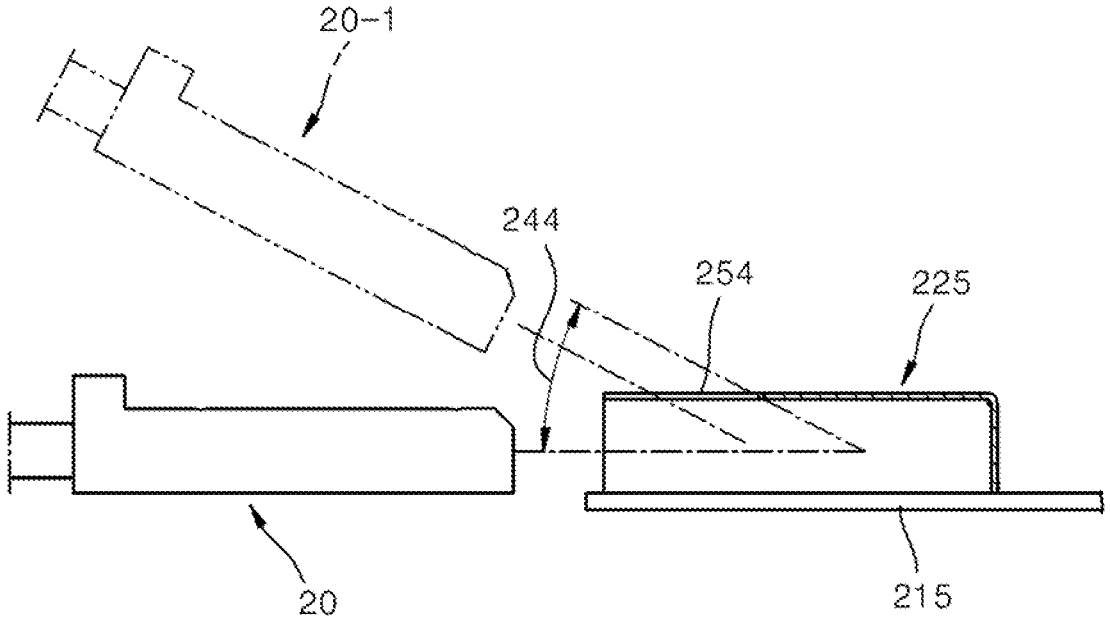
FIG. 14 is a sectional view taken along line VII-VII of FIG. 12A, showing insertion of the male connector 20 into the connector socket 225 of FIG. 12A mounted on the PCB 215.

FIG. 13 is a sectional view taken along line VI-VI of FIG. 6A, showing insertion of the male connector 20 into the connector socket 225 of FIG. 6A mounted on the PCB 215. Referring to FIG. 13, the male connector 20 is inserted in a direction parallel to an upper surface of the PCB 215. FIG. 14 is a sectional view taken along line VII-VII of FIG. 12A, showing insertion of the male connector 20 into the connector socket 225 of FIG. 12A mounted on the PCB 215. Referring to FIG. 14, the male connector 20 may be inserted in a direction parallel to the upper surface of the PCB 215, or may be obliquely inserted at an acute angle or an obtuse angle to the upper surface of the PCB 215 since the connector socket 225 is partially open at the top thereof (see 254 of FIG. 12A).

Figure 15A:
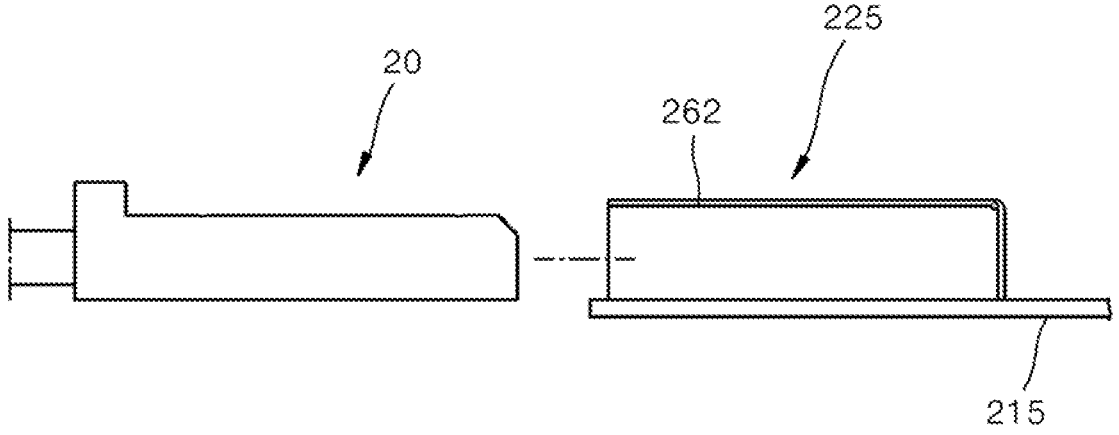
FIG. 15A is a sectional view taken along line VIII-VIII of FIG. 12B, showing insertion of the male connector 20 into the connector socket 225 of FIG. 12B, with a top lid 262 of the connector socket 225 closed.
Figure 15B:
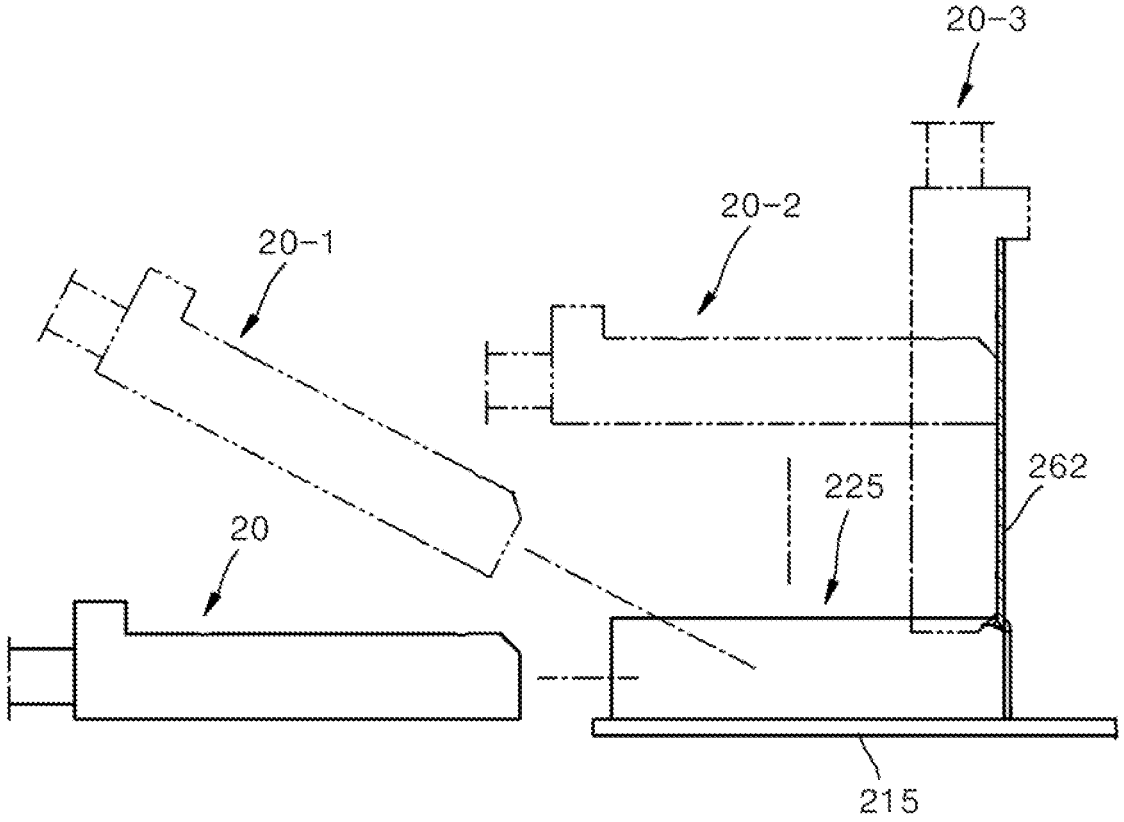
FIG. 15B is a sectional view taken along line VIII-VIII of FIG. 12B, showing insertion of the male connector 20 into the connector socket 225 of FIG. 12B, with the upper lid 262 of the connector socket 225 open at a right angle, an acute angle, or an obtuse angle.

FIG. 15A and FIG. 15B are sectional views taken along line VIII-VIII of FIG. 12B, showing insertion of the male connector 20 into the connector socket 225 of FIG. 12B mounted on the PCB 215. FIG. 15A is a sectional view taken along line VIII-VIII of FIG. 12B, showing insertion of the male connector 20 into the connector socket 225 of FIG. 12B, with the lid 262 of the connector socket 225 closed. Referring to FIG. 15A, the male connector 20 is inserted into the connector socket 225 in a direction parallel to the upper surface of the PCB 215 since the lid 262 of the connector socket 225 is closed.

FIG. 15B is a sectional view taken along line VIII-VIII of FIG. 12B, showing insertion of the male connector 20 into the connector socket 225 of FIG. 12B, with the lid 262 of the connector socket 225 open at a right angle, an acute angle, or an obtuse angle. Referring to FIG. 15A, the male connector 20 may be inserted into the connector socket 225 in a direction parallel to the upper surface of the PCB 215, and the male connector 20-1 may be obliquely inserted at an acute angle or an obtuse angle to the upper surface of the PCB 215. In addition, since the lid 262 of the connector socket 225 is open at a right angle, an acute angle, or an obtuse angle, the male connector 20-2 may be inserted into the PCB 215 while descending at a right angle, an acute angle, or an obtuse angle, and the male connector 20-3 may be inserted into the PCB 215 in a direction in which the lid 262 is closed.

As described above, the male connector 20 can be mounted on the PCB 215 in various ways depending on the shape of the upper surface of the male connector 20. In this way, the compact coaxial cable connector for transmitting super-high frequency signals according to the present invention can be easily installed in a limited space and can be fastened to the PCB in various ways depending on the shape thereof.

Although some embodiments have been described herein with reference to the accompanying drawings, it should be understood by those skilled in the art that these embodiments are given by way of illustration only and the present invention is not limited thereto and that various modifications, variations, and alterations can be made by those skilled in the art without departing from the spirit and scope of the present invention. Therefore, the scope of the invention should be limited only by the accompanying claims and equivalents thereto.

LIST OF REFERENCE NUMERALS

| | |
|---|---|
| 110: Male connector | 112: Male connector housing |
| 114: Electrical signal line | 150: Female connector |
| 152: Female connector housing | 154: Terminal (pin) reception member |
| 20, 20-1, 20-2, 20-3: Male connector | |
| 210: Inner conductor (signal line) | 214: PCB terminal pad |
| 215: Printed circuit board (PCB) | 220: Dielectric |
| 222: Fastening portion | 225: Connector socket |
| 230: Outer conductor (shielding layer) | |
| 232: Surface-mounted member | 240: Sheath (jacket) |
| 242: Through-hole-mounted member | |
| 244: Acute angle at which male connector is inserted | |
| 250: Adapter conductor portion | 254: Upper opening |
| 255: Cable signal line terminal | 256: Connector socket right side |
| 258: Connector socket right opening | |
| 260: Adapter dielectric portion | 262: Connector socket lid |
| 270: Lower shielding member | 272: Adapter reception portion |
| 280: Upper shielding member | 290: Front shielding member |
| 30: Coaxial cable | 40: Adapter unit |
| 42: Adapter | 50: Coaxial cable connected to adapter |
| 60: Unstripped coaxial cable | |

What is claimed is:

1. A compact coaxial cable connector for transmitting super-high frequency signals, which is adapted to connect a printed circuit board (PCB) to multiple super-high frequency coaxial cable signal lines transmitting super-high frequency signals therethrough, the compact coaxial cable connector comprising:

multiple coaxial cables comprising inner conductors, outer conductors, dielectrics, and sheaths, wherein the outer conductors, the dielectrics, and the sheaths are stripped to expose the inner conductors;

multiple conductor portions corresponding to the multiple coaxial cables, the conductor portions comprising first ends configured to electrically contact the exposed inner conductors of the coaxial cables and second ends configured to electrically contact circuit signal line terminal pads formed on the PCB;

a male connector comprising a shielding can including an upper shielding member and a lower shielding member defining cylindrical reception portions, each of the cylindrical portions configured to receive at least a portion of one of the exposed inner conductors of the multiple coaxial cables and at least a portion of one of the multiple conductor portions, thereby securing and protecting ends of the exposed inner conductors, and blocking electromagnetic waves generated from the inner conductors of the multiple coaxial cables; and a connector socket configured to mount on the PCB, receive the shielding can of the male connector, fasten to the male connector, and electrically connect to the shielding can and a ground terminal of the PCB, wherein the connector socket comprises a side and a reclosable lid connected to the side and configured to open, wherein, upon fastening the male connector to the connector socket, the second ends of the conductor portions in the male connector are brought into direct contact with and connected to the circuit signal line terminal pads formed on the PCB without a reception member receiving the exposed inner conductors, and wherein the shielding can entirely shields the rest of the inner conductors except for the second ends of the conductor portions in contact with the signal line terminal pads formed on the PCB.

2. The compact coaxial cable connector according to claim 1, wherein:

the shielding can is connected to the outer conductors of the coaxial cables; and the connector socket receives the shielding can and is electrically connected to the shielding can and the ground terminal of the PCB to electrically shield the exposed inner conductors of the multiple coaxial cables.

3. The compact coaxial cable connector according to claim 1, wherein the connector socket further comprises a fastening portion configured to fasten to the male connector.

4. The compact coaxial cable connector according to claim 1, wherein the connector socket is configured to mount on the PCB by surface-mount technology (SMT) or through-hole mount technology.

5. The compact coaxial cable connector according to claim 1, wherein the connector socket is configured to mount on the PCB by combination of surface-mount technology (SMT) and through-hole mount technology.

6. The compact coaxial cable connector according to claim 1, wherein the connector socket has a cuboid shape, is open at the bottom thereof and at one side thereof into which the male connector is inserted, and is partially open at the top thereof, and wherein the male connector is inserted into the connector socket in a direction parallel to a bottom surface of the PCB or at an angle to the bottom surface of the PCB.

7. The compact coaxial cable connector according to claim 1, wherein the connector socket has a cuboid shape, and is open at the bottom thereof and at one side thereof into which the male connector is inserted; wherein the reclosable lid is configured to open at a right angle, an acute angle, or an obtuse angle; and wherein upon inserting the male connector into the connector socket, the male connector is inserted in a direction parallel to an upper surface of the PCB, is obliquely inserted at an acute angle or an obtuse angle to the upper surface of the PCB, is inserted while descending at a right angle, or is inserted in a direction in which the lid is closed.

8. The compact coaxial cable connector according to claim 1, wherein the connector socket is integrally formed with the PCB.

9. The compact coaxial cable connector according to claim 1, further comprising dielectric portions configured to connect to the conductor portions to separate the first ends and the second ends of the conductor portions.

* * * * *